US005321337A

United States Patent [19]

Hsu

[11] Patent Number: 5,321,337

[45] Date of Patent: Jun. 14, 1994

[54] BALLAST HAVING STARTING CURRENT RESTRAINT CIRCUITRY FOR PREVENTING A LARGE IN-RUSH CURRENT AND PROTECTION CIRCUITRY FOR PREVENTING DAMAGE DUE TO A START-UP FAILURE

[75] Inventor: Clarence Hsu, Taipei Hsien, Taiwan

[73] Assignee: Everay Electronic Co., Ltd., Taiwan

[21] Appl. No.: 975,077

[22] Filed: Nov. 12, 1992

[51] Int. Cl.[5] ..... H05B 37/02

[52] U.S. Cl. ..... 315/219; 315/244; 315/291; 315/DIG. 7; 315/DIG. 5

[58] Field of Search ..... 315/219, 244, 291, 200 R, 315/DIG. 2, DIG. 4, DIG. 5, DIG. 7, 94

[56] References Cited

U.S. PATENT DOCUMENTS

| | | | |
|---|---|---|---|
| 4,104,715 | 8/1978 | Lawson, Jr. | 315/DIG. 5 X |
| 4,165,475 | 8/1979 | Pegg et al. | 315/DIG. 5 X |
| 4,392,087 | 7/1983 | Zansky | 315/219 |
| 5,055,742 | 10/1991 | Jurell et al. | 315/94. |

*Primary Examiner*—Robert J. Pascal
*Assistant Examiner*—Haissa Philogene
*Attorney, Agent, or Firm*—Bacon & Thomas

[57] ABSTRACT

An improved electronic ballast for a florescent lamp includes rectifying/filtering circuity coupled to an A.C. power source, high frequency switching circuitry, starting circuitry connected to the output terminal of the high frequency switching circuitry, and both starting current restraint circuitry connected to the output terminal of the rectifying/filtering circuitry and protection circuitry coupled to the starting circuitry. The starting current restraint circuitry includes a thermistor with a negative temperature coefficient which causes current flows through the filaments of the lamp to gradually increase during activation of the lamp tube so as to modify the heating of the filaments, lengthening the opertional life of the lamp. If a lamp starting failure occurs, a coupling winding in the protection circuitry couples excess voltage to charge a capacitor, which in turn triggers a diac that activates a silicon controlled rectifier to forward bias a diode which brings the transistor gate voltage to ground to stop oscillation of the transistor and prevent continuous high voltage from appearing at both ends of the lamp tube so as to protect the circuit thereof.

5 Claims, 2 Drawing Sheets

BALLAST HAVING STARTING CURRENT RESTRAINT CIRCUITRY FOR PREVENTING A LARGE IN-RUSH CURRENT AND PROTECTION CIRCUITRY FOR PREVENTING DAMAGE DUE TO A START-UP FAILURE

BACKGROUND OF THE INVENTION

The present invention relates to an improved electronic ballast particularly adapted for use in a fluorescent lamp which is intended to lengthen the operation life of the fluorescent lamp tube and to prevent users from electric shock and also guard the fluorescent lamp and the electronic ballast from damage.

At present, most fluorescent lamps use conventional core ballasts; but several new electronic ballast have been developed which save electricity and can operate without a starter, and work with little interference, and are small in size and light in weight. As a result of the above cited advantages, these novel ballasts are taking the place of conventional ones rapidly. FIG. 1 shows a commercially successful recent electronic ballast. It works rather like a half-bridge converter; the household low frequency AC voltage (60 HZ) is transformed into a stable DC voltage by means of rectifying /filtering circuitry 10A . The converted DC voltage is input to high frequency switching circuitry 20A . After the high frequency switching circuitry 20A is actuated by charging circuitry 30A, i.e., on the charging capacitor being charged by a charging circuitry 30A to such an extent that the DIAC 32A is actuated, a conversion transistor Q1 of the high frequency switching circuitry 20A is first activated to work, and then the driving transformers L1, L2, L3 mounted onto the same core are mutually induced to render the conversion transistors Q1, Q2 to be quickly actuated in turn, i.e. only one of the transistors is turned on at a time, with the other off.

As a result of the high speed interchanged activation of the transistors Q1, Q2, the current in the inductor L4 is directed from left to right on the activation of the transistor Q1 and is directed from right to left on the activation of the transistor Q2. Therefore, the inductor L4 and the lamp tube 40A, received an alternating current. Since the interchanged activation of the transistors Q1, Q2, is rather speedy, the current in the inductor L4 and the lamp tube can be treated as a high frequency alternating current. In other words, when the high frequency switching circuitry 20A has been triggered to act, it can oscillate to output a high frequency alternating current to the lamp tube 40A. The inductor L4, acting as a current ballast, can limit an excessive current from flowing through the lamp tube 40A so as to prevent the lamp tube 40A from being burned by an excessive current. As a result of the supply of this high frequency alternate current, the inductor L4 and a capacitor C1 begin to resonate so as to generate a high resonant voltage at both ends of the lamp tube 40A, causing each filament 41A to be quickly heated with electrons emitted therefrom to activiate the inert gas in the lamp tube to illuminate the lamp. After the lamp tube 40A is actuated, the impedance thereof drops and the current therein is increased so that most of the current will not flow through the capacitor C1, ending up with the inductor L4 and the capacitor C2 resonating. The capacitance of the capacitor C2 is far larger than that of the capacitor C1, and thus the natural resonance frequency is shifted to the lower frequency region. This shift in natural resonance frequency changes the operational Q point of the circuit. As a result, the circuit is not in its optimal resonating state as it is in the starting stage. Therefore, the output voltage and wattage generated by the circuit is substantially lowered after the actuation of the lamp. From then till the cut-off of the electrical power, the lamp tube 40A can be illuminated by way of a steady output voltage and current.

The above cited prior art electronic ballast is characterized in that it is small in size, light in weight, fast to start the lamp, saves in electricity and works without a starter, and the operation frequency is above 25 KHZ so as to produce no flickering; however, there are some disadvantages in practical operation that are as follows:

1. An instantly generated inrush current is applied to the filaments of the lamp tube on the starting of each lamp; as a result the on/off operation on the lamp tube is so frequent that the oxidized substance on the filaments will be dissipated as a result of the high temperature caused by the instant large inrush current after a relatively short period of time, and the filaments are apt to burn out; this will shorten the operation life of the lamp tube greatly.

2. If the lamp tube can not be ignited in a specific time or can not be lighted up at all, the prior art ballast will be constantly subject to a resonating state with continuous high voltages generated at both ends of the lamp tube, causing the lamp tube to be subject to continuous, rather than instant, high voltages resulting in damage to the ballast circuits.

3. As stated in point 2, the abnormal continuous high voltages and power will have a damaging effect on the circuits of the ballast, especially on the conversion transistors which can be easily burned out.

The present inventor has noticed the above cited disadvantages of the hereinbefore described circuit and worked out an improved one which can work better and safer.

SUMMARY OF THE INVENTION

Therefore, the primary object of the present invention is to provide an improved electronic ballast which is comprised of a rectifying /filtering circuitry, a starting current restraint circuitry, a high frequency switching circuitry, a protection circuitry, and a starting circuitry wherein the rectifying /filtering circuitry and the high frequency switching circuitry are used to convert a low frequency input A.C. voltage into a high frequency output A.C. voltage. The starting circuitry employs an inductor and capacitors in cooperation with each other to produce resonance in the circuitry so that the fluorescent lamp can be started and continuously illuminated. During the activation of the lamp tube, a starting current restraint circuitry is used to limit the current flowing through the filaments and make the current increase gradually so as to alleviate the heating process to such an extent that the oxidized substance on the filaments will be dissipated in a slower manner, resulting in the lengthening of the operation life of the fluorescent lamp.

Another object of the present invention is to provide an improved electronic ballast adapted for a fluorescent lamp wherein a protection circuitry is used not only to detect an abnormal condition in which the lamp can not be started in a specific time or can not be started at all, but also to make the conversion transistors of the high frequency switching circuitry stop oscillating to prevent the circuit from being in its optimal resonance stage for too long, resulting in the protection of the lamp tube from damage and the protection of the circuits of the ballast from burning up.

One further object of the present invention is to provide an improved electronic ballast adapted for a fluorescent lamp wherein the lamp tube and the high frequency switching circuitry is isolated by an isolation output transformer so that the lamp tube and the power source are not grounded together, making the same well insulated; even a user accidentally touching the lamp tube when replacing the same will not be electrically shocked.

BRIEF DESCRIPTION OF THE INVENTION

DETAILED DESCRIPTION OF THE PREFERRED EMBODIMENT

Figure 1:
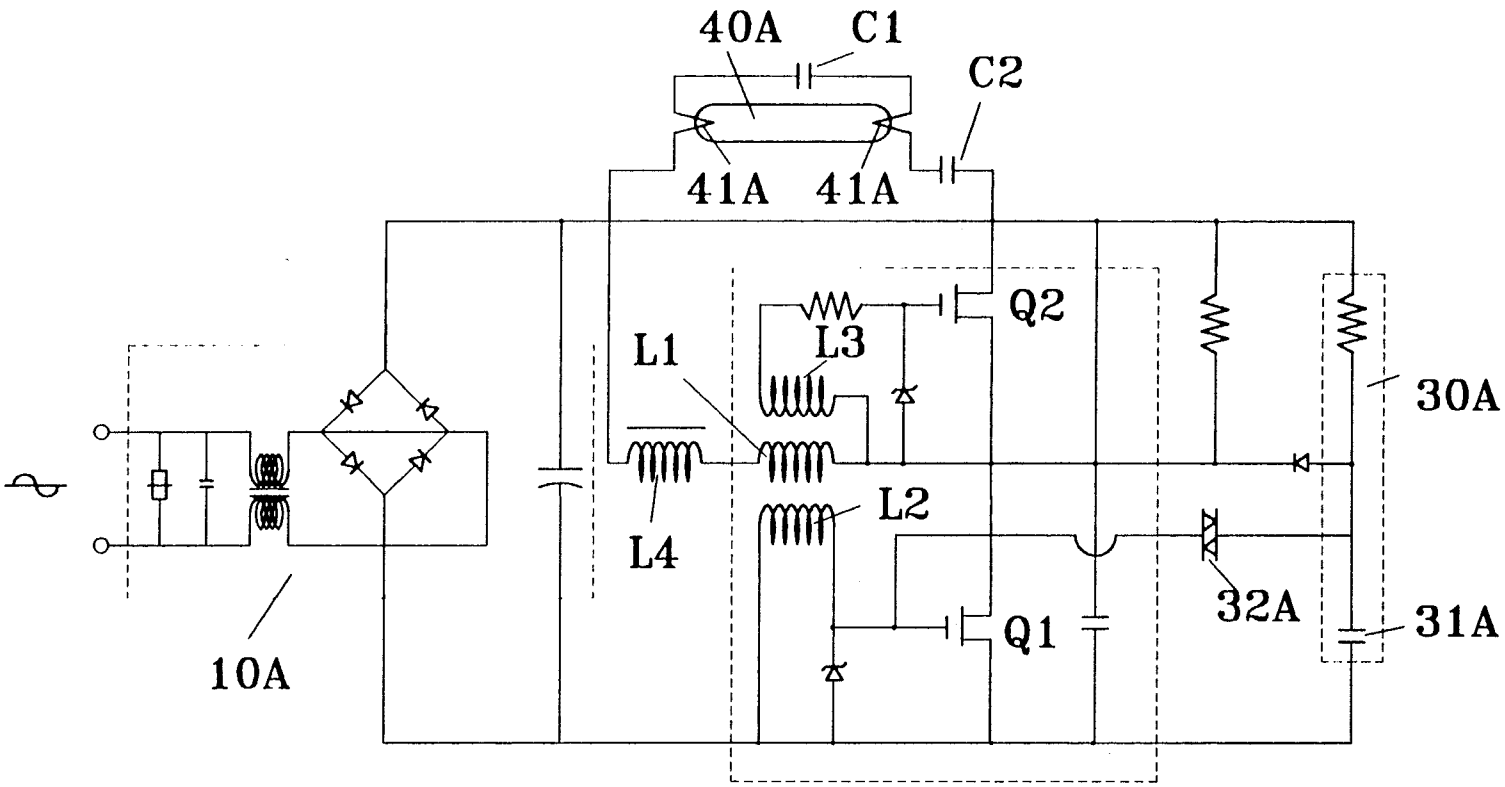
FIG. 1 (PRIOR ART)
FIG. 1 is a diagram showing the circuitry of a prior art electronic ballast.
Figure 2:
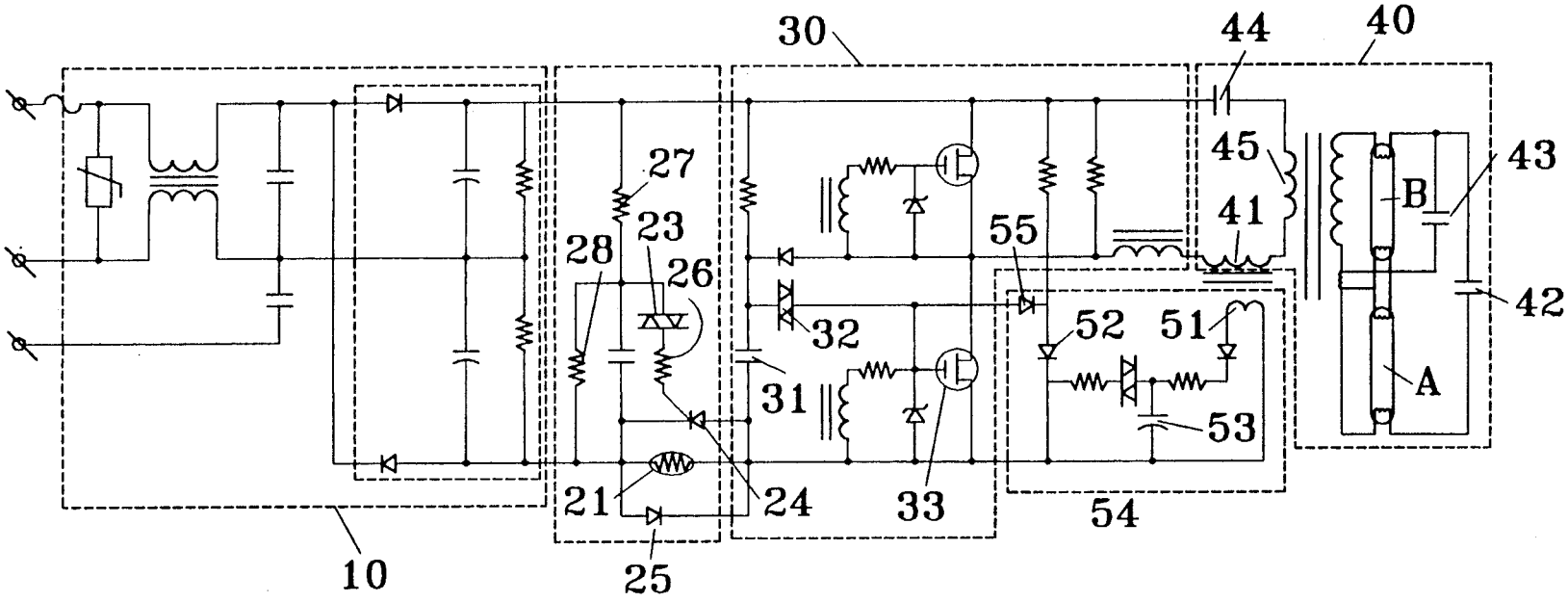
FIG. 2 is a diagram showing the circuit of the present invention.
Figure 2:
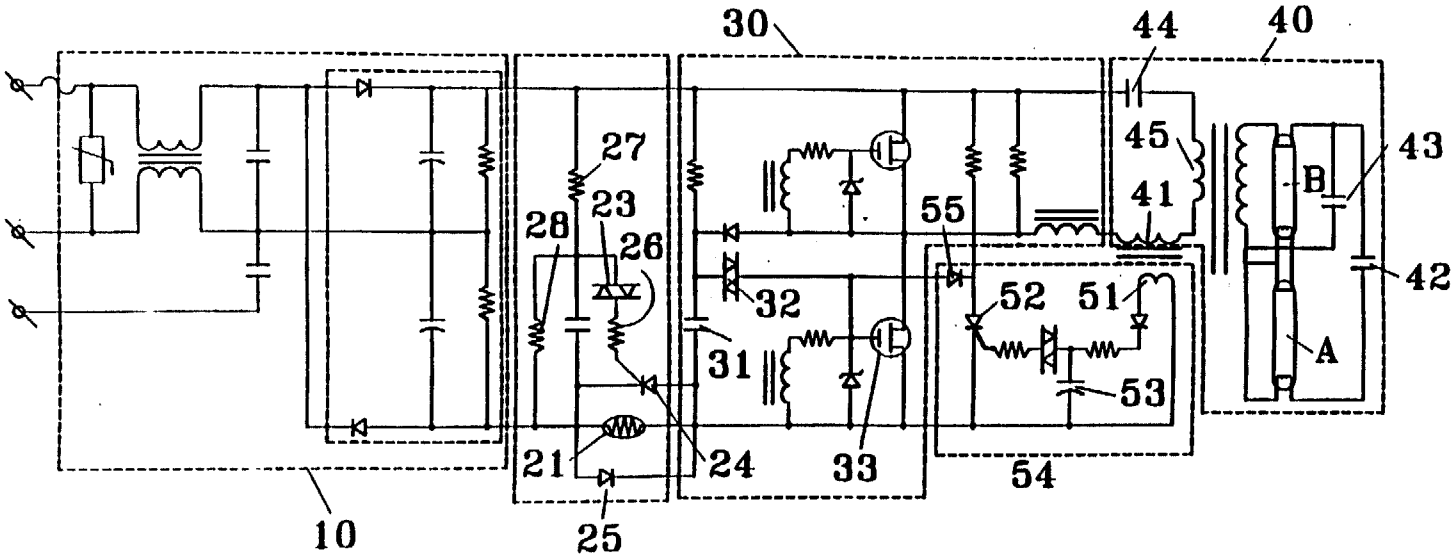

Referring to FIG. 2, the electronic ballast of the present invention includes rectifying / filtering circuitry 10 abbreviated as R / F circuitry, starting current restraint circuitry 20 connected to the output terminal of the R / F circuitry 10, high frequency switching circuitry 30, starting circuitry 40 coupled to the output terminal of the high frequency switching circuitry 30, protection circuitry 50 coupled to the starting circuitry 40. The R / F circuitry 10 is used to convert a household A.C. power source into a D.C. source by way of a bridge rectifier; and when the capacitor 31 is charged to such an extent that the DIAC 32 is actuated to work, the whole high frequency switching circuitry 30 is thus triggered to convert the above cited D.C. voltage into high frequency A.C. voltage which is then delivered to the starting circuitry 40. The inductor 41 of the starting circuitry 40 begins to resonate with the capacitor 42 at this instant, causing the alternate actuation of the lamp tubes A and B by way of high resonance voltages; after the actuation of the lamp tubes A, B, the inductor 41 resonates with the capacitor 44 having a larger capacitance thus shifting the natural resonance frequency to the lower frequency region so as to generate a lower output voltage and current to keep the lamp tubes electrically discharged and illuminated and enable the inductor 41 to effectively act as a current ballast to restrain excessive currents from flowing to the lamp tubes A, B.

In case the lamp tubes A, B, can not be actuated in a specific time or can not be started at all, the high current flowing through the lamp tubes will cause the inductor 41 to respond so as to make the coupling winding 51 of the protection circuitry 50 accordingly induce an adequate voltage thereon which will keep the capacitor 53 charged until a voltage to activate the DIAC 54 is reached. Then, the silicon controlled rectifier 52 is activated as a result of the triggering of the diode DIAC 54, thus causing the diode 55 to be forward biased and bringing the transistor gate voltage to ground to terminate the resonance of the whole high frequency switching circuitry 30, whereby the supply of high frequency alternating current is stopped accordingly.

The thermistor 21 of the starting current restraint circuitry 20 has a negative temperature coefficient ( NTC ) so that when the lamp tubes A, B, are activated, the currents flowing through the filaments thereof will be increased gradually ( as the initial resistance of the thermister 21 is large at first, the passing of the current therethrough makes its temperature rise up and the resistance thereof decreases so that the current is gradually increased accordingly with the decreasing resistance of the thermistor). When the current is increased to such an extent that the filaments of the lamp tubes can be activated and the lamp tubes are illuminated; i.e., when the capacitor 22 has been charged to such a voltage that the DIAC 23 is triggered, resulting in the activation of the silicon controlled rectifier 24 whereby after the lamp tubes are started, the currents will no longer pass through the thermistor 21, avoiding the dissipation of electrical energy on the thermistor, and improving the efficiency of the whole circuitry accordingly. In other words, at the instant the lamp tubes are activated, there will be no instant large inrush current generated due to the restraint provided by the thermistor 21. Thus, the heating of the filament will not be so abrupt and the oxidized substance thereon will be well protected so as to lengthen the operation life of the lamp tubes.

Referring further to the starting circuitry 40, the lamp tubes A, B, can obtain higher output voltage from the high frequency switching circuitry 30 by way of coupled of the isolation output transformer 45 thereto. Also, the grounding of the lamp tubes is not common with that of the power source; therefore, a user who accidentally touches the circuitry of the lamp tubes will not get electrically shocked.

As shown in FIG. 2, the improved ballast of the present invention is characterized in that the starting current restraint circuitry 20 is disposed between the rectifying / filtering circuitry 10 and the high frequency switching circuitry 30 by means of a loop having a thermistor 21 with a negative temperature coefficient ( NTC ) which is in parallel connection with a silicon controlled rectifier 24 ( SCR ) and a diode 25 disposed in a reverse direction with respect to the silicon controlled rectifier ( SCR ); and the gate terminal of the silicon controlled rectifier 24 is connected to a resistor 26 and a DIAC 23 to which a capacitor 22 is connected. The capacitor 22 is connected to the cathode end of the silicon controlled rectifier 24; and the capacitor 22 is further connected to a voltage division resistor 28 which is then connected to a DC bus voltage to constitute the starting current restraint circuitry 20, whereby at the instant the lamp tubes A, B are activated by the starting circuitry 40, the currents flowing through the filaments of the lamp tubes are controlled to increase gradually by way of the thermistor 21 and further to activate the silicon controlled rectifier by way of the capacitor 22 and the DIAC 23, after the lamp tubes are activated, so the current will not pass through the thermistor 21 but through the silicon controlled rectifier instead so as to reduce the dissipation of energy on the thermistor.

Moreover, the starting circuitry 40 is provided with a capacitor 44 and an inductor 41 which are connected to the ends of a primary winding of an isolation output transformer 45; and the secondary winding of the transformer 45 is connected to a pair of series connected lamp tubes A, B with a capacitor 42 connected in parallel thereto, and one of the lamp tubes is further in parallel connection to another capacitor 43, whereby the lamp tubes are powered by the output of the high frequency switching circuitry 30 as a result of the electrical coupling of the primary and secondary windings of the transformer 45 so that the lamp tubes A, B and the power source thereof are not commonly grounded, preventing the lamp tubes from electrical leakage.

As further shown in FIG. 2, the coupling winding 51 of the protection circuitry 50 is coupled to an inductor 41 on a common core so that an adequate voltage can be induced to charge a capacitor 44 which controls the operation state of a DIAC 54 that in turn controls the operation state of a silicon controlled rectifier 52 ; and the silicon controlled rectifier is in control of the actuation of a diode 55 connected to the gate of a conversion transistor 33 of the high frequency switching circuitry 30 whereby in case the lamp tubes A, B are not activated in a specific time, adequate current and voltage will be induced on the coupling winding 51 from the inductor 41 to charge the capacitor 53 to such extent that the DIAC 54 is activated along with the silicon controlled rectifier 52 and the diode 55, causing the gate of the conversion transistor 33 to be grounded so as to terminate the oscillation of the high frequency switching circuitry.

It is clearly apparent that the present invention provides starting current restraint circuitry 20, starting circuitry 40 and protection circuitry 50 to improve a conventional electronic ballast so as to lengthen the operation life of a lamp tube, protect the circuits of the ballast itself and prevent users from being electrically shocked.

I claim:

1. An electronic ballast, comprising rectifying/filtering circuitry connected to an A.C. power source; starting current restraint circuitry and high frequency switching circuitry both connected to the output terminal of said rectifying/filtering circuitry; starting circuitry connected to the output terminal of said high frequency switching circuitry; and protection circuitry in coupling association with said starting circuitry; wherein said starting current restraint circuitry is disposed between said rectifying/filtering circuitry and said high frequency switching circuitry by means of a loop having a thermistor with a negative temperature coefficient (NTC) which is in parallel connection with a silicon controlled rectifier (SCR) and a diode disposed in a reverse direction with respect to said silicon controlled rectifier; and wherein the gate terminal of said silicon controlled rectifier is connected to a resistor and a DIAC to which a capacitor is connected, said capacitor being connected to the cathode end of said silicon controlled rectifier, and said capacitor being further in connection to a voltage division resistor which is then connected to the DC bus voltage to constitute said starting current restraint circuitry, whereby at the instant said lamp tubes are activated by said starting circuitry, the currents flowing through the filaments of said lamp tubes are controlled to increase gradually by way of said thermistor; and further to activate said silicon controlled rectifier by way of said capacitor and said DIAC after said lamp tubes are activated, so that the current will not pass through said thermistor but through said silicon rectifier.

2. An electronic ballast as claimed in claim 1, wherein said starting circuitry is provided with a capacitor and an inductor which are connected to the ends of a primary winding of an isolation output transformer; and the secondary winding of said transformer is connected to a pair of series connected lamp tubes with a capacitor connected in parallel thereto, and one of said lamp tube is further in parallel connection to another capacitor, whereby said lamp tubes are powered by the output of said high frequency switching circuitry as a result of the electrical couplation of said primary and secondary windings of said transformer so that said lamp tubes and the power source thereof are not commonly grounded, preventing said lamp tubes from electrical leakage accordingly.

3. An electronic ballast as claimed in claim 1, wherein a coupling winding of said protection circuitry is coupled to an inductor on a common core so that an adequate voltage can be induced to charge a capacitor, and further comprising transistor gate grounding means for connecting a gate of a switching transistor to ground in response to charging of said capacitor, whereby in case said lamp tubes are not activated in a specific time, adequate current and voltage will be induced on said coupling winding from said inductor to get said capacitor charged to such an extent that said grounding means is activated along with said silicon controlled rectifier and said diode, causing the gate of said conversion transistor to be grounded so as to terminate the oscillation of said high frequency switching circuitry.

4. An electronic ballast, comprising rectifying filtering circuitry connected to an A.C. power source; starting current restraint circuitry and high frequency switching circuitry both connected to the output terminal of said rectifying/filtering circuitry; starting circuitry connected to the output terminal of said high frequency switching circuitry; and protection circuitry in coupling association with said starting circuitry; wherein a coupling winding of said protection circuitry is coupled to an inductor on a common core so that an adequate voltage can be induced to charge a capacitor, and further comprising transistor gate grounding means for connecting a gate of a switching transistor to ground in response to charging of said capacitor, whereby in case said lamp tubes are not activated in a specific time, adequate current and voltage will be induced on said coupling winding from said inductor to get said capacitor charged to such an extent that said grounding means is activated along with said silicon controlled rectifier and said diode, causing the gate of said conversion transistor to be grounded so as to terminate the oscillation of said high frequency switching circuitry.

5. A ballast as claimed in claim 4, wherein said transistor grounding means includes a DIAC controlled by the capacitor, which in turn controls the operation state of a silicon controlled rectifier, said silicon controlled rectifier in turn controlling activation of a diode connected between said transistor gate and ground.

* * * * *

UNITED STATES PATENT AND TRADEMARK OFFICE

CERTIFICATE OF CORRECTION

PATENT NO. : 5,321,337

DATED : June 14, 1994

INVENTOR(S) : Clarence Hsu

It is certified that error appears in the above-indentified patent and that said Letters Patent is hereby corrected as shown below:

The title page, should be deleted to appear as per attached title page.

On the title page, under the heading of "Abstract," in the first line, the word "florescent" should be changed to —fluorescent—.

Delete Figure 2 of the drawings and substitute the attached corrected drawing of Figure 2.

Signed and Sealed this

Twenty-eight Day of March, 1995

*Attest:*

Bruce Lehman

BRUCE LEHMAN

*Attesting Officer*

*Commissioner of Patents and Trademarks*

United States Patent [19]

Hsu

[11] Patent Number: 5,321,337

[45] Date of Patent: Jun. 14, 1994

[54] BALLAST HAVING STARTING CURRENT RESTRAINT CIRCUITRY FOR PREVENTING A LARGE IN-RUSH CURRENT AND PROTECTION CIRCUITRY FOR PREVENTING DAMAGE DUE TO A START-UP FAILURE

[75] Inventor: Clarence Hsu, Taipei Hsien, Taiwan

[73] Assignee: Everay Electronic Co., Ltd., Taiwan

[21] Appl. No.: 975,077

[22] Filed: Nov. 12, 1992

[51] Int. Cl.[5] ..... H05B 37/02

[52] U.S. Cl. ..... 315/219; 315/244; 315/291; 315/DIG. 7; 315/DIG. 5

[58] Field of Search ..... 315/219, 244, 291, 200 R, 315/DIG. 2, DIG. 4, DIG. 5, DIG. 7, 94

[56] References Cited

U.S. PATENT DOCUMENTS

| | | | |
|---|---|---|---|
| 4,104,715 | 8/1978 | Lawson, Jr. | 315/DIG. 5 X |
| 4,165,475 | 8/1979 | Pegg et al. | 315/DIG. 5 X |
| 4,392,087 | 7/1983 | Zansky | 315/219 |
| 5,055,742 | 10/1991 | Jurell et al. | 315/94 |

*Primary Examiner*—Robert J. Pascal
*Assistant Examiner*—Haissa Philogene
*Attorney, Agent, or Firm*—Bacon & Thomas

[57] ABSTRACT

An improved electronic ballast for a florescent lamp includes rectifying/filtering circuity coupled to an A.C. power source, high frequency switching circuitry, starting circuitry connected to the output terminal of the high frequency switching circuitry, and both starting current restraint circuitry connected to the output terminal of the rectifying/filtering circuitry and protection circuitry coupled to the starting circuitry. The starting current restraint circuitry includes a thermistor with a negative temperature coefficient which causes current flows through the filaments of the lamp to gradually increase during activation of the lamp tube so as to modify the heating of the filaments, lengthening the opertional life of the lamp. If a lamp starting failure occurs, a coupling winding in the protection circuitry couples excess voltage to charge a capacitor, which in turn triggers a diac that activates a silicon controlled rectifier to forward bias a diode which brings the transistor gate voltage to ground to stop oscillation of the transistor and prevent continuous high voltage from appearing at both ends of the lamp tube so as to protect the circuit thereof.

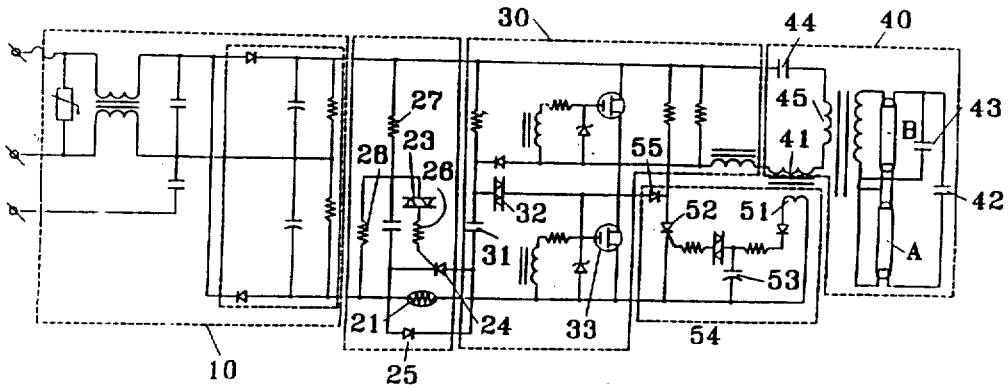

5 Claims, 2 Drawing Sheets